US005906499A

United States Patent [19]

Sikora et al.

[11] Patent Number: 5,906,499

[45] Date of Patent: May 25, 1999

[54] ELECTRICAL PLUG-AND-SOCKET CONNECTION

[75] Inventors: Andreas Sikora, Hagen; Michael Wiese, Ennepetal, both of Germany

[73] Assignee: Delphi Automotive Systems Deutschland GmbH, Wuppertal, Germany

[21] Appl. No.: 08/669,404

[22] PCT Filed: Oct. 28, 1995

[86] PCT No.: PCT/DE95/01498

§ 371 Date: Jul. 2, 1996

§ 102(e) Date: Jul. 2, 1996

[87] PCT Pub. No.: WO96/14675

PCT Pub. Date: May 17, 1996

[30] Foreign Application Priority Data

Nov. 7, 1994 [DE] Germany ..... 44 39 684

[51] Int. Cl.[6] ..... H01R 13/52

[52] U.S. Cl. ..... 439/271; 439/272

[58] Field of Search ..... 439/271–277

[56] References Cited

U.S. PATENT DOCUMENTS

| | | | |
|---|---|---|---|
| 3,550,065 | 12/1970 | Phillips | 439/272 |
| 3,937,545 | 2/1976 | Cairns et al. | 439/272 |
| 4,637,674 | 1/1987 | Kobler | 439/271 |
| 4,946,402 | 8/1990 | Fink et al. | 439/274 |
| 5,372,516 | 12/1994 | Maeda | 439/271 |

FOREIGN PATENT DOCUMENTS

| | | | |
|---|---|---|---|
| 404162379 | 6/1992 | Japan | 439/271 |
| 2167249 | of 1986 | United Kingdom . | |

*Primary Examiner*—J. J. Swann
*Attorney, Agent, or Firm*—Cary W. Brooks

[57] ABSTRACT

In order to configure an electrical plug-and-socket connection (1) comprising two complementary, latchable housing parts (2, 3) and comprising a sealing member (11) construction with annular lamellae (12, 13) in such a way that it is liquid-tight and its housing parts (2, 3) can be plugged into one another and withdrawn from one another with a low expenditure of force, the annular lamellae (12, 13) are constructed with different diameters (D1, D2) and act in a tapering insertion section (7) of one housing part (2) as a lamella seal and as a compression seal. (FIG. 4.)

4 Claims, 4 Drawing Sheets

ELECTRICAL PLUG-AND-SOCKET CONNECTION

The invention proceeds from an electrical plug-and-socket connection in accordance with the preamble of claim 1.

Such a plug-and-socket connection is disclosed in DE 35 40 831 C2. The plug-and-socket connection described therein consists of a first and a second housing part. A hollow cylindrical sealing member, which is arranged on a cylindrical component in one of the two housing parts, has lips of different diameter in an alternating sequence. The larger lips in this case overlap the socket-shaped insertion section of one of the housing parts. As a result, these sealing lips are deflected arcuately in the axial direction upon coupling of the plug-and-socket connection. The small lips delimit the interspace available for the bent sealing lips, and have no sealing function. The housing parts are locked after their end position is reached.

U.S. Pat. No. 4,946,402 discloses a further such plug-and-socket connection, whose sealing member likewise has sealing lips of different diameter. Both the continuous conical construction of the insertion region of the first housing part, and the corresponding arrangement of the sealing lips cause compression of all the sealing lips between the housing parts when the plug-and-socket connection is brought together. The sealing principle, applied there, of compression sealing is very expensive in terms of force, resulting in-a correspondingly high force component in the plug-in force. The type of sealing is unsatisfactory from this aspect of optimizing the expenditure of force.

DE-AS 25 55 147 describes a plug-and-socket connection in which the sealing between the housing parts is likewise performed essentially according to the above-named principle. A hollow cylindrical sealing member having three radial sealing lips is fastened to a cylindrical component of one housing part. The outside diameter of the three sealing lips is larger than the inside diameter of a socket-shaped housing part, with the result that the lips of the sealing member are deflected arcuately in the axial direction when the housing parts are pushed together. When the plug-and-socket connection is coupled, the air is compressed and escapes along the inner walls of the socket-shaped housing part and the outer ends of the sealing lips, the result being that the arcuate course is produced thereby and by the oversized lips. Locking of the housing parts does not take place, since the adhesive properties of the rubber and the bent sealing lips do not permit inadvertent decoupling. The separating forces increase with the number of sealing lips.

Moreover, it is known from DE-OS 2745887 to arrange a sealing member between a high-voltage cable and a housing part for the purpose of producing a gas-tight connection. After the cable end has been fitted with the sealing member, it is inserted into the housing part and secured with a metal sleeve at the rear. A cable receiving opening in the housing part extends conically in order to permit a simple interplugging with the sealing member, which is of beveled construction. Three sealing lips arranged outside on the sealing member ar constructed in accordance with the beveling with a decreasing diameter. The effect of the metal sleeve is, inter alia, that the sealing lips are compressed in the insertion opening and thus ensure tightness.

A further watertight connection is disclosed in U.S. Pat. No. 4,417,736. In this case, a cylindrical housing part is arranged in a socket-shaped housing part with the interposition of a seal. The seal encloses the cylinder and is beveled like the cylinder itself in the plug-in direction. The receptacle of the socket-shaped housing part has a form which is the complement of this. The sealing member is formed with compressible lips on the inner and outer walls, which ensure adequate sealing and simultaneously decrease centering problems.

The above-named plug-and-socket connections exhibit the basic principles of sealing housing parts by means of a sealing member constructed with lips. Depending on the degree of oversizing of the sealing lip diameter with respect to the inside diameter of the socket-shaped housing part, a deflection of the sealing lip in the axial direction is understood as a lamella seal, while pinching of the sealing lip in the radial direction is known as a compression seal.

When the housing parts are interplugged, in addition to the friction forces for sealing it is necessary to apply further forces which, when added, are defined as the so-called plug-in force. Because of the general aim of miniaturization, the ratio of contact parts per surface area has increased, and the plug-in force has risen as a result. These plug-and-socket connections are difficult to handle during assembly. The reverse movement, that is to say the drawing apart of the housing parts, is likewise expensive in terms of force, since with a rising number of lamellae the sealing member is sucked tight because of the lack of pressure balance. Consequently, the sealing principles of the previously known plug-and-socket connections have to be adapted to the more stringent requirements relating to ease of assembly.

It is therefore the object of the invention to configure a plug-and-socket connection according to the preamble of claim 1 such that it is constructed in a liquid-tight fashion and its housing parts can be plugged into one another and withdrawn from one another with a low expenditure of force.

This object is achieved by means of the features specified in the characterizing part of claim 1.

When such a plug-and-socket connection is plugged together, the plug-in force is composed of a plurality of components. Depending on the structure of the housing parts and number of instances of contacting, the system can be closed only with extreme expenditure of force. The particular configuration of the sealing member and of the insertion section contributes to the force reduction. The housing parts are protected against the ingress of liquid by two annular lamellae of different diameter. The low number of lamellae and the combination of a lamella seal and a compression seal permit sealing which is low in friction. Moreover, the short path on which the annular lamellae come into contact with the housing wall ensures good pressure balancing, with the result that in this regard only low forces need to be expended. This measure also has a positive effect during decoupling of the plug-and-socket connection. The housing parts can easily be separated from one another, since the pressure difference is extremely slight.

According to the invention, the plug-in force is substantially reduced owing to the fact that the structure of the housing parts is selected such that the force components do not add together but occur sequentially, resulting in a virtually constant expenditure of force over the entire displacement path at a low level. Referred to the path covered during the plugging-together, the mutual insertion of the contact parts and the inception of the locking of the housing are performed in a short displacement. After the insertion forces have been overcome, a constant but low contact force is required for the further displacement of the contact parts. The maximum force to be expended to lock the housing occurs in the meantime. After said maximum has been passed, the final locking is performed automatically as it were, with the aid of the pre-stressing, with the result that the friction forces then first occurring for the sealing do not raise the overall force level. The relief of the latching means and the sealing process which takes place at the same time compensate one another with respect to the expenditure of force.

In the relief of the latching means, the first housing part is displaced into the final position in the second housing part. The latching means consist in principle in each case of a projection, beveled on both sides, which cooperates with an opening arranged, for example, on an arm of the other housing part. The relief takes place after the maximum deflection of the arm has passed, which arm then slides, with the advance of the first housing part, into the second housing part along the inclined bevel. In order to optimize the plug-in force, sealing takes place only on this short part of the displacement path.

The material for the sealing member, in particular for the annular lamellae, must have good sealing properties and good sliding properties. Silicone fulfills these contrary demands best.

In order to facilitate the handling of the sealing member during assembly, it is constructed with three annular lamellae. Only two annular lamellae are required for the sealing function, although it must be ensured that the annular lamella with the smaller diameter faces the socket region of the second housing part. Since the difference is diameter can be discerned only with difficulty by the human eye, given the small overall dimensions of the sealing member, a third annular lamella has been arranged in addition in order to avoid faulty plugging-in. The result is a symmetrical structure, the sealing member thus being plugged without a code.

The difference between the lamella diameters is advantageously in the range around 1 mm and is a function of the angular position of the insertion section. This insertion section is kept as short as possible with reference to the assembly path so that the force component for the placement of the seal becomes effective only over a short distance of the insertion path. As a result, this component can be integrated optimally in the force characteristic in order to obtain a force level which is low overall. It is particularly advantageous from this aspect to step the insertion section. Each lamella is given its specific range of action and therefore causes only the expenditure of force which is absolutely necessary.

The invention will now be explained with reference to an exemplary embodiment and with the aid of the drawings, in which FIG. 1 shows the plug-and-socket connection in a longitudinal section;

Figure 1:
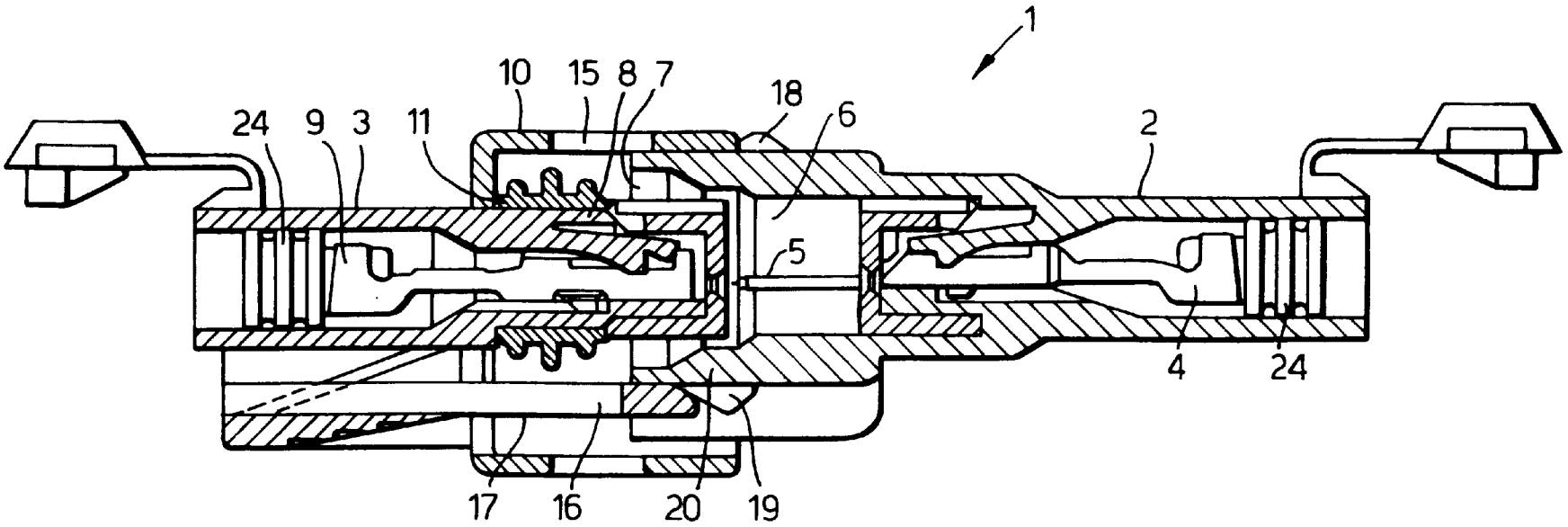
Figure 2:
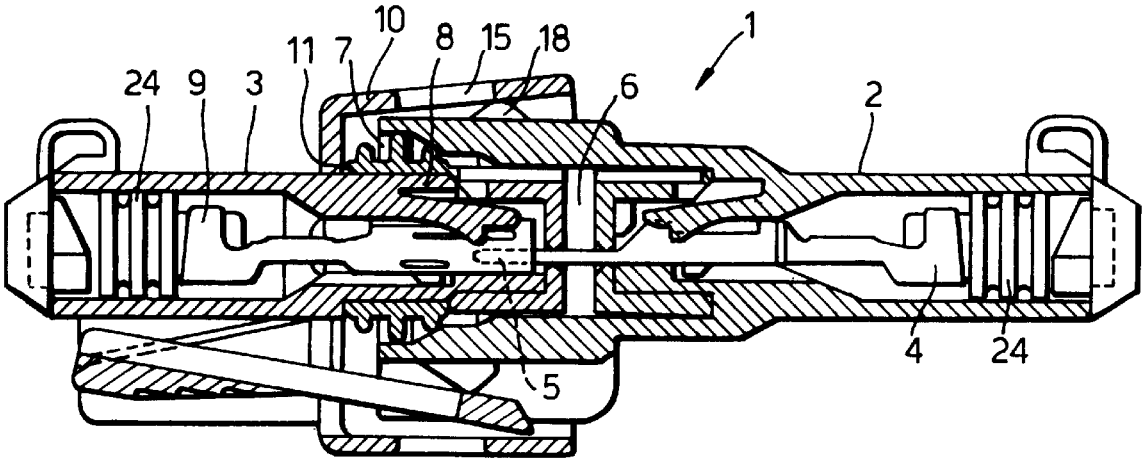
FIG. 2 shows the housing parts in a longitudinal section during the first contact of the sealing member with the second housing part.

In the exemplary embodiment described below, only the components essential to the invention are provided with reference numerals. FIGS. 1, 2 and 4 represent a plug-and-socket connection 1 to a scale of 2.5:1, while a scale of 5:1 is realized in FIGS. 3 and 5. The electrical plug-and-socket connection 1 comprises a first housing part 2 and a second housing part 3. Arranged in the first housing part 2 is a contact part 4 whose tip 5 projects into a socket region 6. This socket region 6 serves to receive the second housing part 3 and is constructed for this purpose with an insertion section 7 of specific construction.

The second housing part 3 comprises a cylindrical part 8, in which a contact part 9 is arranged, and a housing shell 10 surrounding the cylindrical part 8. A hollow cylindrical sealing member 11 is constructed on the outside with three annular lamellae 12, 13 and 14 is pushed onto and fastened on the cylindrical part 8, the middle annular lamella 13 having a larger diameter D1 than the two outer annular lamellae 12 and 14, which are of the same size and have the diameter D2. Only the two annular lamellae 12 and 13 with the different diameters D1 and D2 are required for the sealing function. The third annular lamella 14, which likewise has a small diameter D2, serves exclusively to produce a symmetrical lamella structure, in order to facilitate assembly in which end is relevant. When the two housing parts 2 and 3 are being plugged into one another, an opening 15 in the housing shell 10 and an opening 16 in a deflectable arm 17 cooperate with projections 18 and 19, beveled on both sides, on a housing wall 20 of the first housing part 2.

The plugged together of the two housing parts 2 and 3 is explained in more detail below.

In FIG. 1, the second housing part 3 is inserted so far into the first housing part 2 that the cylindrical part 8 projects into the socket region 6, and the housing shell 10 and the arm 17 butt against the projections 18 and 19. The contact parts 4 and 9 do not yet touch one another. The force previously requiring to be expended serves exclusively to overcome the sliding friction between the housing shell 10 and the arm 17 and the housing wall 20.

Figure 3:
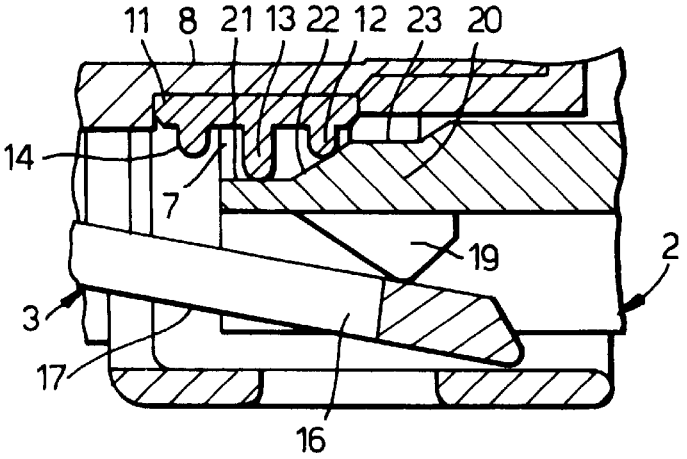
FIG. 3 shows an enlarged part section in accordance with FIG. 2.
Figure 4:
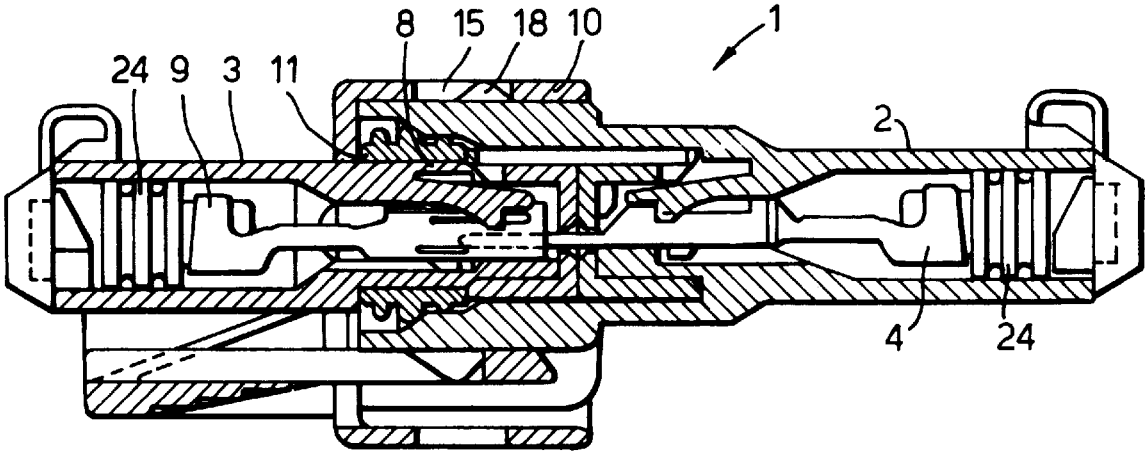
FIG. 4 shows the housing parts in a longitudinal section in their locked end position.

In the position in accordance with FIG. 2 and FIG. 3, the second housing part 3 is pushed further into the first housing part 2. The tip 5 of the contact part 4 is already inserted into the contact part 9 and has thus concluded the insertion movement, which is expensive in terms of force. As the operation of assembling the contact parts 4 and 9 is continued, only slight friction forces remain to be overcome. The housing shell 10 and the arm 17 were deflected to a maximum extent by the beveled projections 18 and 19. If this process of movement is considered from the aspect of force alone, two rising force components are added to one another of which the contact force of the contact parts 4 and 9 falls away and remains at a uniform level, while the locking force has strongly increased. At this point in time, the sealing member 11 has a point of contact with the first housing part 2 for the first time, but does not yet go over into the balance of forces.

Figure 5:
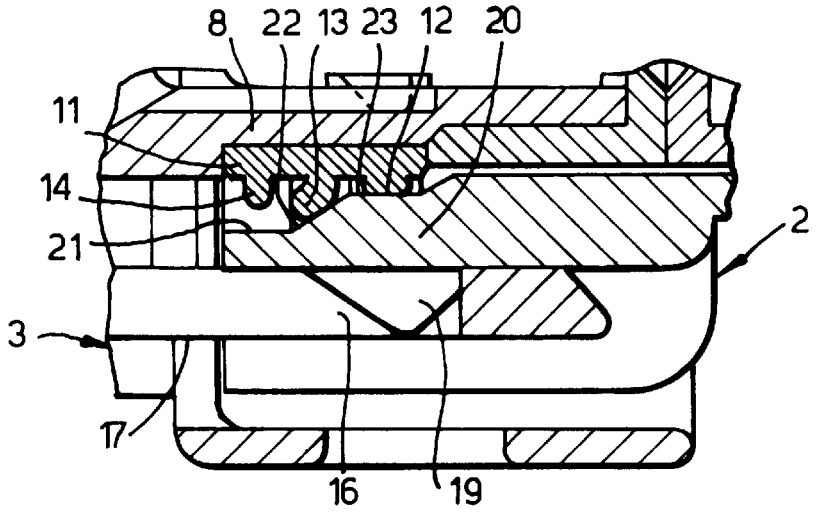
FIG. 5 shows an enlarged part section in accordance with FIG. 4.

FIGS. 4 and 5 represent the two housing parts 2 and 3 in their end position, that is to say the plug-and-socket connection has been completed. The projections 18 and 19 are situated in the openings 15 and 16 and lock the housing parts 2 and 3. The contact part 4 is completely inserted into the contact part 9. The sealing member 11 is situated between the cylindrical part 8 and the housing wall 20 and prevents the ingress of liquid between the housing parts 2 and 3. By contrast with FIG. 2, the second housing part 3 has been pushed completely into the first housing part 2, the arm 17 and the housing shell 10 coming to rest in a quasi automatic fashion owing to the restoring forces with the assistance of the beveled projections 18 and 19. The annular lamellae 12 and 13 of th sealing member 11 first come into contact with the circumferential insertion section 7 in the socket region 6 of the first housing part 2 at the moment when the restoring forces are released.

The insertion section 7 is stepped. A bevel 22 is located between two steps 21 and 23. The first step 21 permits the sealing body 11, and thus the second housing part 3, to be advanced easily, since the diameter D3 of the first step 21 is equal to the diameter D1 of the middle annular lamella 13, while the front annular lamella 12 advances bearing against the bevel 22 and is slightly deformed. Upon further advance, the middle annular lamella 13 slides along the first step 21 into the bevel 22 and is arcuately deflected opposite to the plug-in direction. The front annular lamella 12 goes over from the bevel 22 to the second step 23. The diameter D4 of the step 23 is smaller than the diameter D2 of the annular lamella 12. The annular lamella 12 is therefore strongly compressed there. In this position, the outer locking of the housing parts 2 and 3 is concluded, and the plug-and-socket connection is produced completely. During the displacement, the air located in and between the housing parts 2 and 3 is pushed past along the insertion section 7 and the sealing member 11, thus ensuring satisfactory pressure balancing. The locking is therefore performed without difficulty from this aspect as well. Moreover, it also supports the decoupling, since there is no need to remove a sealing member 11 which has been sucked tight. In order to seal the plug-and-socket connection 1 in the line insertion region as well, appropriate line seals 24 are used there.

Figure 6:
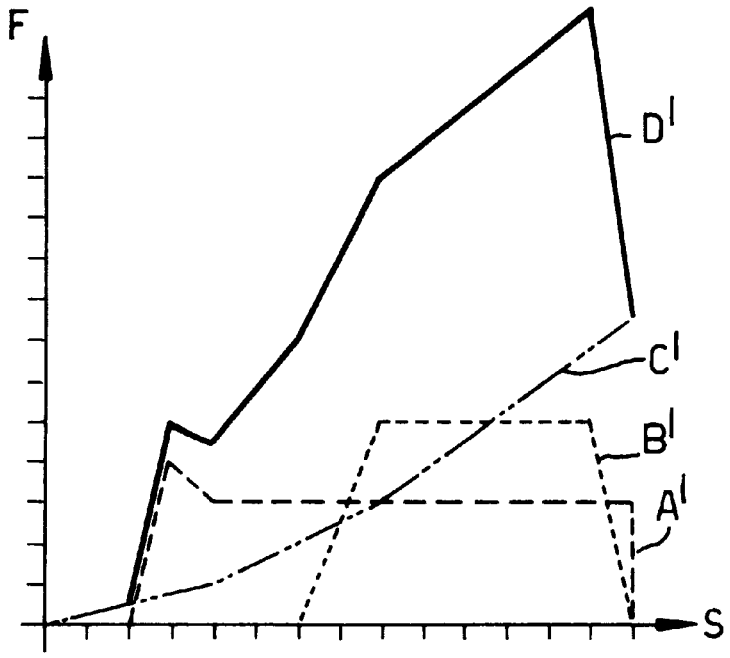
FIG. 6 shows a diagram of the characteristic of the plug-in force of a conventional plug-and-socket connection.
Figure 7:
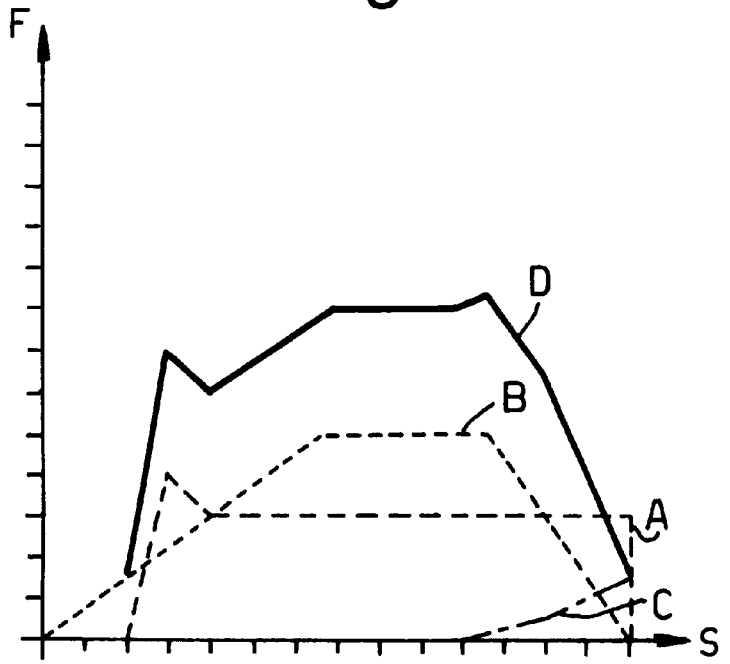
FIG. 7 shows a diagram of the characteristic of the plug-in force of a plug-and-socket connection according to the invention.

FIGS. 6 and 7 reveal the difference between the force components of a conventional plug-and-socket connection with a lamella seal and a plug-and-socket connection 1 according to the invention. Comparable force components are denoted here by the same letters, although the force components of the conventional plug-and-socket connection are additionally provided with an apostrophe. The characteristic of the contact forces A and A' between the contact parts is the same for the two plug-and-socket connections over the entire displacement path B. During the insertion of the contact parts into one another, the contact forces A and A' rise strongly and thereafter fall off to a constantly low level. The sealing force B' of the conventional plug-and-socket connection has already started before the contact force A' and rises continuously. Moreover, the latching force C' is added to this starting from half of the displacement path S, resulting in the production of a strongly rising plug-in force D' which does not drop until directly before the end position of the plug-and-socket connection by relief of elastic latching means.

By contrast, the latching force C of the plug-and-socket connection 1 according to the invention already occurs in a slightly rising fashion before the contact force A (FIG. 7). Up to the maximum deflection of the latching means, the resulting plug-in force D is formed only from the latching force C and the contact force A. The sealing force B does not occur until the relief of the elastic latching means. The sealing force B is overcompensated by the latching force C released, with the result that the plug-in force D drops in conjunction with a constant contact force A. Distribution of the force-generating devices over the complete displacement path S of the plug-and-socket connection 1 results in a liquid-tight connection with the minimum expenditure of force. This advantage is effective, in particular, in the case of multipole plug-and-socket connections, since there the plug-in force rise with increasing number of poles.

| List of reference symbols: | |
|---|---|
| 1 | plug-and-socket connection |
| 2 | first housing part |
| 3 | second housing part |
| 4 | contact part |
| 5 | tip |
| 6 | socket region |
| 7 | insertion section |
| 8 | cylindrical part |
| 9 | contact part |
| 10 | housing shell |
| 11 | sealing member |
| 12 | annular lamella with diameter D2 |
| 13 | annular lamella with diameter D1 |
| 14 | annular lamella with diameter D2 |
| 15 | opening |
| 16 | opening |
| 17 | arm |
| 18 | projection |
| 19 | projection |
| 20 | outer wall |
| 21 | first step with diameter D3 |
| 22 | bevel |
| 23 | second step with diameter D4 |
| 24 | line seal |
| A | contact force |
| A' | contact force |
| B | sealing force |
| B' | sealing force |
| C | latching force |
| C' | latching force |
| D | plug-in force |
| D' | plug-in force |
| S | displacement path |

What is claimed is:

1. An electrical plug-and-socket connection comprising a first housing part (2) with a socket region (6), comprising a second housing part (3) with a cylindrical part (8) which can be received in the socket region (6), latching elements (15, 16, 18, 19) which are constructed on the first housing part (2) and on the second housing part (3), the latching elements (15, 16, 18, 19) including projections (18, 19) having beveled on both sides and engageable in complementary openings (15, 16) formed in a flexible arm of one of the housing parts, mateable electrical contacts arranged in the first housing part (2) and in the second housing part (3), a hollow cylindrical sealing member (11) which can be pushed onto the cylindrical part (8) and which is constructed on the outside with at least two flexible annular lamellae (12, 13) which are of different diameter (D1, D2) and extend in the radial direction, wherein, the socket region (6) is constructed with a stepped conical insertion section (7), the annular lamella (12) with the smaller diameter (D2) faces the first housing part (2) and is radially compressed between the housing wall (20) thereof and the sealing member (11), and the annular lamella (13) with the larger diameter (D1) acts as a lamella seal against the stepped conical intersection section, and wherein the latching elements (15, 16, 18, 19) are arranged on the housing parts (2, 3) so that upon mating the first and second housing parts the flexible arm first engages the beveled projections so that the arm is deflected by the projections and upon further axial movement of the housing parts in the mating direction the flexible arm reaches a maximum deflection with an associated increase in insertion force and thereafter upon still further axial movement of the housing parts the insertion force is reduced and so that the initial contact of the two annular lamellae (12, 13) with the insertion section (7) takes place after the maximum deflection of the flexible arm has occurred.

2. The electrical plug-and-socket connection as claimed in one of claim 1, wherein the sealing member (11) including the annular lamella (12, 13) consists of silicone.

3. The electrical plug-and-socket connection as claimed in one of claim 1, wherein the diameter (D1) of the larger annular lamella (13) is larger by at least 1 mm than the diameter (D2) of the smaller annular lamella (12).

4. The electrical plug-and-socket connection as claimed in one of claim 1, wherein the sealing member (11) has three annular lamellae (12, 13, 14), the middle annular lamella (13) having a larger diameter (D1) than the outer annular lamellae (12, 14), which are of the same size.

* * * * *